US005872323A

United States Patent [19]

Norton et al.

[11] Patent Number: 5,872,323

[45] Date of Patent: Feb. 16, 1999

[54] GAS OPERATED FIREARM PISTON/PISTON SEAL ASSEMBLY

[75] Inventors: Vincent B. Norton; Derek L. Watkins, both of Elizabethtown, Ky.

[73] Assignee: Remington Arms Co., Inc., Elizabethtown, Ky.

[21] Appl. No.: 905,147

[22] Filed: Aug. 1, 1997

[51] Int. Cl.[6] ..... F41B 5/18

[52] U.S. Cl. ..... 89/191.02; 89/193

[58] Field of Search ..... 89/191.02, 192, 89/193, 191.01, 26

[56] References Cited

U.S. PATENT DOCUMENTS

| | | | |
|---|---|---|---|
| 2,909,101 | 10/1959 | Hillberg | 89/191 |
| 3,174,401 | 3/1965 | Beretta | 89/192 |
| 3,200,710 | 8/1965 | Kelly et al. | 89/191 |
| 3,420,140 | 1/1969 | Beretta | 89/193 |
| 3,443,477 | 5/1969 | Kaempf | 89/128 |
| 3,568,564 | 3/1971 | Badali | 89/191 |
| 3,572,729 | 3/1971 | Hodil, Jr. | 89/26 |
| 3,601,002 | 8/1971 | Janson | 89/191 |
| 3,657,960 | 4/1972 | Badali | 89/191 |
| 3,707,110 | 12/1972 | Alday | 89/193 |
| 3,709,092 | 1/1973 | Tazome | 89/191 |
| 3,799,131 | 3/1974 | Bolton | 123/119 A |
| 3,810,412 | 5/1974 | Zamacola | 89/191 A |
| 3,848,511 | 11/1974 | Zanoni | 89/191 A |
| 3,945,296 | 3/1976 | Hyytinen | 89/191 A |
| 3,968,727 | 7/1976 | Hyytinen | 89/191 A |
| 4,085,654 | 4/1978 | Panigoni | 89/191 A |
| 4,174,654 | 11/1979 | Liedke | 89/191 A |
| 4,389,920 | 6/1983 | Dufour, Sr. | 89/190 |
| 4,872,392 | 10/1989 | Powers et al. | 89/193 |
| 4,901,623 | 2/1990 | Lee | 89/193 |
| 5,218,163 | 6/1993 | Dabrowski | 89/193 |
| 5,429,034 | 7/1995 | Badali et al. | 89/193 |

OTHER PUBLICATIONS

Remington Arms Company Inc., Remington Automatic Shotgun, Sep. 1, 1981, three pages, 89/191.02.

*Primary Examiner*—Stephen M. Johnson
*Attorney, Agent, or Firm*—Rhodes, Coats & Bennett, L.L.P.

[57] ABSTRACT

A gas sealing device for a gas-operated firearm having a piston with a land surface positioned between a lateral flange and a peripheral rib, and a piston seal radially mounted on the land surface and positioned between the lateral flange and the peripheral rib. In operation, the piston and the piston seal can remain interlocked, but still operational so that upon firing, the piston is deflected towards the magazine tube due to the force applied by the piston seal. The piston seal exerts the force on the piston due to the impingement of a propellant gas charge on the piston seal.

16 Claims, 5 Drawing Sheets

GAS OPERATED FIREARM PISTON/PISTON SEAL ASSEMBLY

FIELD OF THE INVENTION

This invention relates to gas operated autoloading firearms and more particularly, to a piston and piston seal arrangement for sealing the gas chamber of a gas-operated firearm.

BACKGROUND OF THE INVENTION

For every modern firearm, whether manual or automatic, six steps of operation must be accomplished after firing. Those steps include unlocking the action, extraction of the spent cartridge casing from the firing chamber, ejection of the spent casing, cocking the hammer for the next round, feeding a new round into the firing chamber and locking the action back into battery. In an autoloading firearm, each of these steps is performed by the firearm itself. A semiautomatic firearm performs these steps for each pull of the trigger.

There are three main types of systems for semiautomatic firearm operation: recoil, blow back and gas. In the first of these, the firearm's recoil or kick thrusts the barrel and breech-bolt rearward to operate the action. Conversely, in blow back operation, recoil is used to force the breechblock back without moving the barrel. Each of these systems has been adapted to a wide range of hand-fired and shoulder-fired guns.

The third system for semiautomatic firearm operations has become the most prevalent. Gas-operated firearms and gas-operated shotguns in particular have gained wide acceptance and popularity with firearms enthusiasts. Gas-operated mechanisms, as opposed to blow back or recoil-operated mechanisms, provide a number of advantages. For example, the speed of fire for semiautomatic weapons may be much higher. Also, the heavy operating parts needed by recoil and blow back systems can be avoided, particularly with high-powered cartridges. Thus, overall gun weight is reduced. Moreover, gas operation can be more precisely controlled to generate only the amount of force necessary to cycle the firearm action. Gas operation also provides the additional benefit of spreading the force of recoil out over a longer time frame therefore making the recoil less noticeable and therefore less objectionable to the shooter. Controlling the recoil force in this manner also tends to make the weapon more accurate.

An early gas-operated mechanism for autoloading firearms is disclosed in U.S. Pat. No. 3,200,710 to Kelly, et al. ('710), assigned to the same assignee as this application. The contents of that patent are incorporated herein by reference in its entirety.

In one type of gas operated firearm, a gas port or small hole in the barrel allows propellant powder gas to enter a gas cylinder and to exert pressure on some kind of piston. The piston engages a connecting rod at a forward end with the rear end connected to the firearm action. As the piston is driven rearward by the rapidly expanding propellant gas pressure, the connecting rod works the gun action to perform the steps outlined above. A return recoil spring typically located in the gun stock provides the force necessary to return the action to battery after the spent shell casing has been extracted and ejected. The piston must withstand the repeated subjection to the violent thrusting forces generated by the propellant gas and also the corrosive nature of that gas.

Many of today's gas operated shotguns feature a gas chamber created around the gun magazine tube which is located adjacent to and directly beneath the gun barrel. The gas chamber resides between the outside surface of the magazine tube and the inside surface of a cylindrically-shaped member, commonly called a gas cylinder, connected to the barrel. The piston in this design is a circular member which encircles the magazine tube inside the gas chamber. During the piston's travel through the gas chamber, a gas seal must be provided between the piston and the magazine tube and the piston and the cylindrical member to take full advantage of the powder gas force.

The piston and piston seal described in the '710 patent operate as described above and provided a substantial performance improvement over other designs of the time. However, it has been found that this design may experience stress crack failures. This failure in some instances may render the firearm inoperative, leading those consumers to become dissatisfied with the perceived quality of the firearm. The failures are believed to stem from twisting and/or torquing of the piston and piston seal as they travel along the magazine tube. The relatively small length to diameter ratio of these components may contribute to their susceptibility to twist induced stress cracking. Also, the inside diameter of each component is in sliding contact with the magazine tube that over time may become fouled with deposits and residue from the powder gas. These deposits may cause the piston and piston seal to bind during their travel along the tube.

Thus, there is a need then for a new gas chamber sealing device which will provide the required gas seal, improve service life and address the additional problems described above.

SUMMARY OF THE INVENTION

This invention comprises a gas sealing device for a gas-operated firearm having a piston with a land surface positioned between a lateral flange and a peripheral rib, and a piston seal radially mounted on the land surface and positioned between the lateral flange and the peripheral rib. In operation, the piston and the piston seal can remain interlocked, but still operational so that upon firing, the piston is deflected towards the magazine tube due to the force applied by the piston seal. The piston seal exerts the force on the piston due to the impingement of a propellant gas charge on the piston seal.

In another embodiment, the piston has an inside diameter, an outside diameter, a front end and a back end. A lateral flange at the piston back end, an outwardly facing peripheral rib is spaced apart from the lateral flange, wherein the inside diameter of the piston is in sliding contact with the magazine tube. The piston seal encircles the piston and is positioned between the lateral flange and the peripheral rib for sealing engagement with a gas cylinder.

In another embodiment, a gas sealing device for a gas-operated autoloading firearm is provided. The device comprises an unslotted piston configured so as to be slidably mounted on the magazine tube. A slotted piston seal is provided and positioned radially on the piston in such a manner that the piston seal remains positioned on the piston during the operation of the firearm. The slotted piston seal operates to substantially form a seal between the piston seal and gas cylinder sufficient to allow the gas-operated firearm to accomplish its autoloading function. The unslotted piston can further have a first inclined surface, and the slotted piston seal can have a second inclined surface. During operation, the first inclined surface contacts with the second inclined surface to cause the piston to substantially form a seal with the gas cylinder.

These and other aspects of the present invention will become apparent to those skilled in the art after a reading of the following description of the preferred embodiments when considered in conjunction with the drawings.

DETAILED DESCRIPTION OF THE PREFERRED EMBODIMENTS

Figure 1:
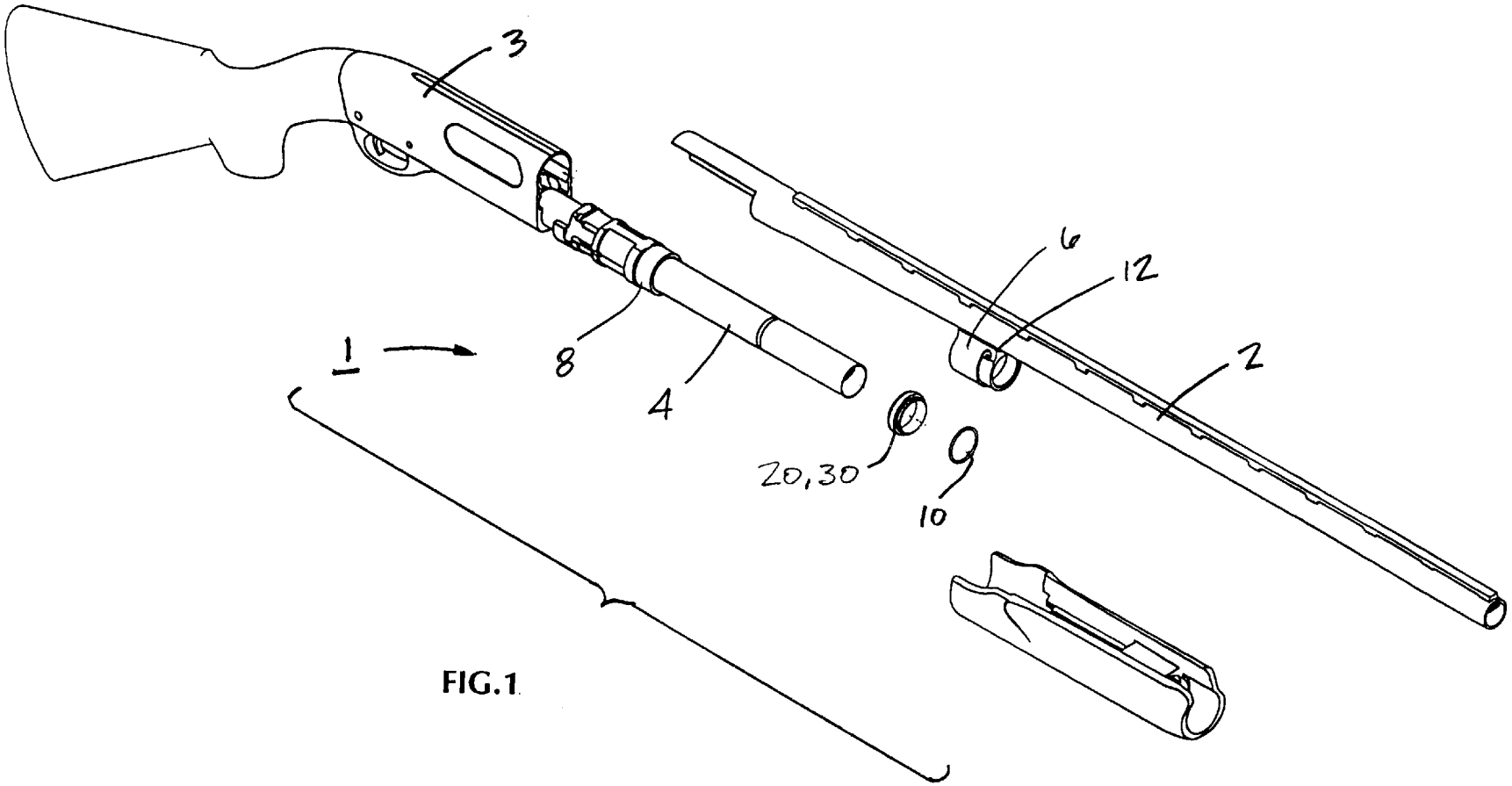
FIG. 1 is an exploded perspective view of a firearm incorporating the gas sealing device of the present invention.

Turning to FIG. 1, there is illustrated a gas-operated autoloading firearm, in this case a shotgun, indicated generally at 1. The shotgun comprises a barrel assembly 2 mounted in a receiver 3. A magazine tube 4 for holding fresh shells is provided adjacent to and parallel to the barrel. The magazine tube 4 is mounted at its rear end in the receiver 3. This firearm configuration is representative of firearms on sale today, and is typified by a popular model such as the Remington Model 11-87.

A gas operating device for the shotgun is comprised of a gas cylinder 6 mounted on the barrel assembly 2 so as to surround at least a portion of the magazine tube 4 when assembled. The gas cylinder is in communication with the barrel interior via at least one opening or port 12 in the barrel assembly 2.

When the firearm is assembled, a gas chamber 7 (see FIG. 4) is defined between the magazine tube 4 and the gas cylinder 6. The gas chamber 7 need not have a very large volume since the propellant gas generated during firing creates a great deal of pressure and force to operate the firearm. Barrel seal member 10 is placed at the front end of cylinder 6 to prevent the propellant gas from escaping out of the gas cylinder 6. This seal may take the form of a rubber-type o-ring or an equivalent. Behind the barrel seal 10, a piston 20 and piston seal 30 are slidably mounted on the magazine tube 4. Action bar sleeve 8 (also called inertia sleeve) slides along the magazine tube 4, and serves to cycle the gun action responsive to the force generated by the propellant gas acting in the gas chamber 7.

As will be appreciated by one of ordinary skill in the art, the shotgun action is shown in battery with the hammer cocked and ready to fire. At this point, piston 20 and piston seal 30 are both located forward in gas cylinder 6.

Figure 3:
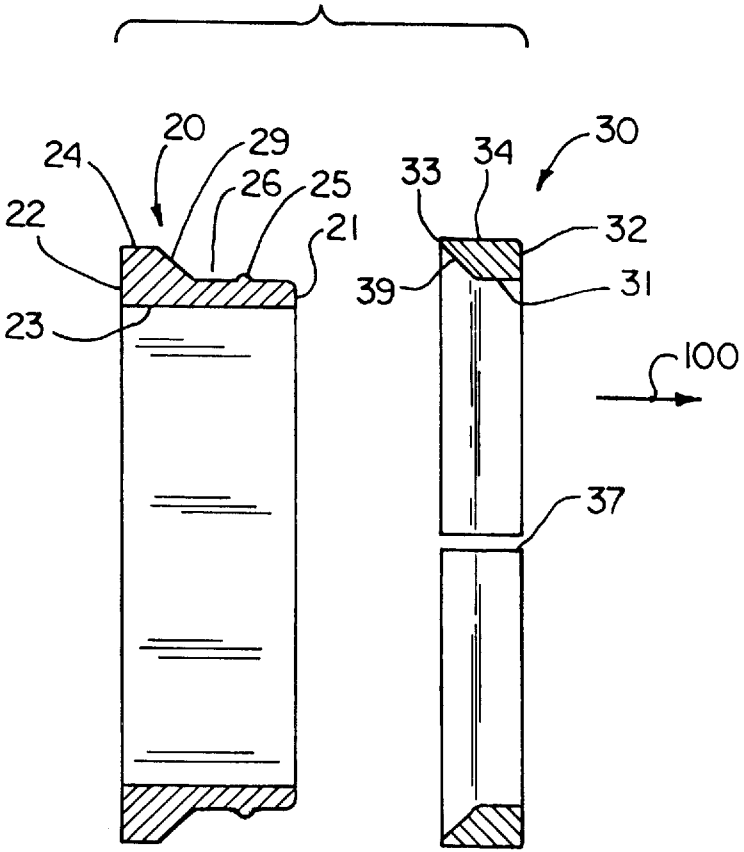
FIG. 3 is an exploded sectional view taken along A—A in FIG. 2.
Figure 2:
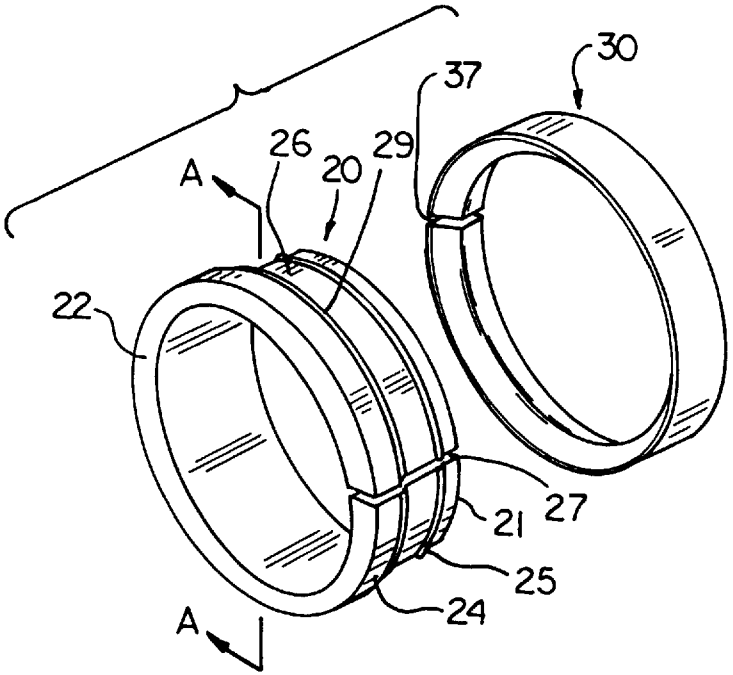
FIG. 2 is an exploded perspective view of the piston/piston seal assembly of the present invention.

Piston 20 and piston seal 30 are shown in more detail in FIGS. 2–5. FIG. 2 shows the two items in perspective. FIG. 3 is a sectional view taken along A—A at FIG. 2. In FIG. 3 it can be seen that the piston 20 includes a front end 21, a back end 22, an inside surface 23, and a lateral flange positioned at the back end 24. In a preferred embodiment, the piston 20 may also include an outwardly extending peripheral rib 25. A land surface 26 is defined between lateral flange 24 and the rib 25. Piston seal 30 includes an interior surface 31, the width of which preferably is no more than that of the land surface 26 of piston 20 in one embodiment. The piston seal also includes a front end 32 and a back end 33. These two components are positioned on magazine tube 4 such that the muzzle direction of the gun is as indicated by arrow 100. Both the piston 20 and the piston seal 30 may further include longitudinal slots 27 and 37, respectively.

Figure 4:
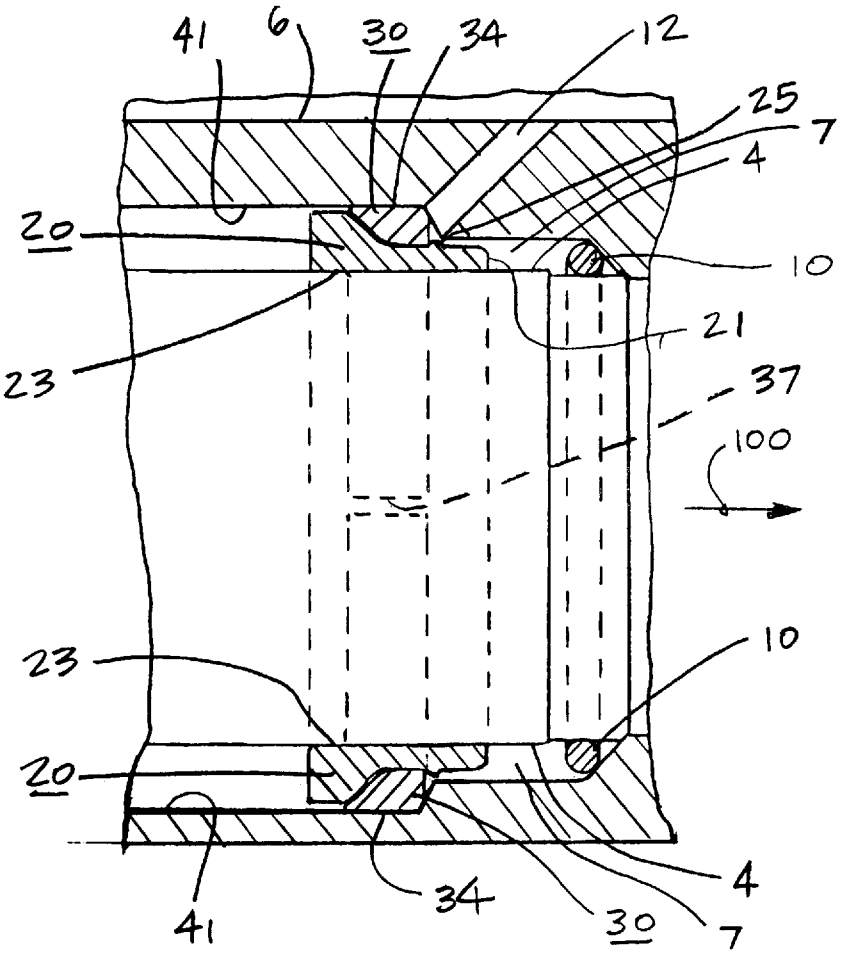
FIG. 4 is a sectional view of the piston/piston seal assembly positioned on the magazine tube of a gas-operated firearm.
Figure 5:
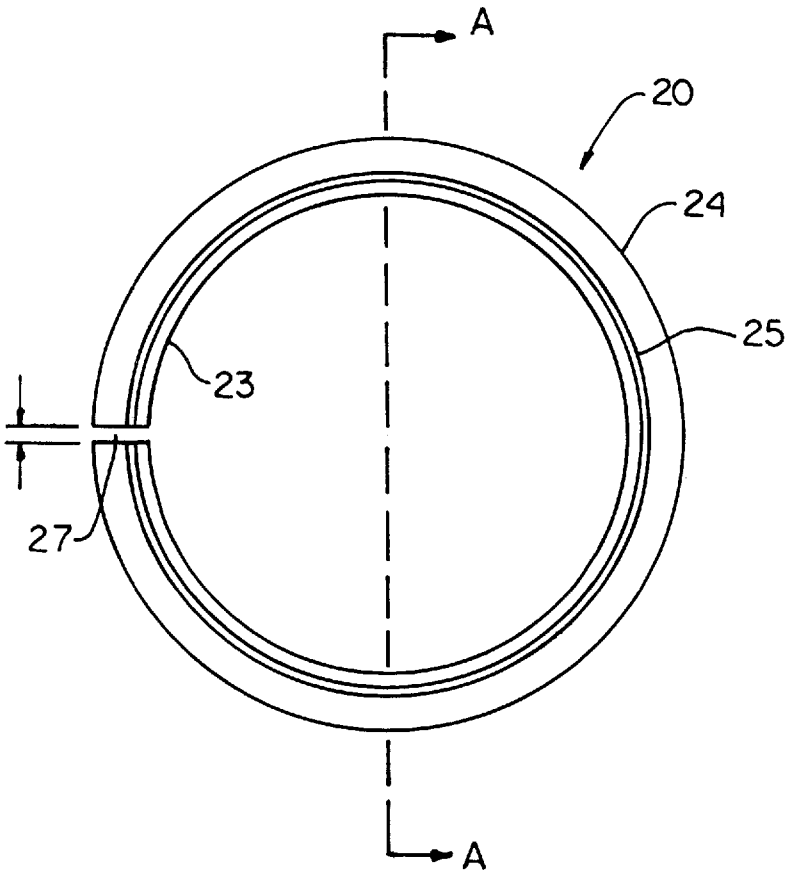
FIG. 5 is a front view of the piston of the present invention.

The concentric relationship of the piston 20 and piston seal 30 in an assembled configuration is illustrated in FIG. 4. As was described above, magazine tube 4 is centered in cylinder 6 to define gas chamber 7 between the magazine tube 4 and the inside diameter of the cylinder. Piston 20 is positioned in gas chamber 7 so as to encircle the magazine tube 4. Piston seal 30 encircles and forms a concentric relationship with piston 20 at the land surface and is positioned by lateral flange 24 and peripheral rib 25. The outer surface 34 of the piston seal 30 is in sliding contact with the cylinder inside surface 41 while the inside surface 23 of the piston 20 is in sliding contact with the magazine tube 4. Neither the lateral flange 24 or the peripheral rib 25 of the piston 20 contact the cylinder inside surface 41. Similarly, the piston seal 30 inside surface 31 does not contact the magazine tube 4. The clearance between the piston 20 and the gas cylinder seal 30 is about 0.002+/−0.002 inches. The clearance between the gas cylinder seal 30 and the gas cylinder 6 is about 0.0025 inches. Each of these dimensions refers to the relaxed state prior to firing and the subsequent introduction of propellant gas into gas chamber 7. In a preferred embodiment, mating angled surfaces 29, 39 are provided on the piston 20 and piston seal 30, respectively, to facilitate their functioning as described below.

Both the piston 20 and piston seal 30 can be fabricated from AISI 4140 steel alloy that has been pre-hardened to a minimum Rockwell hardness standard HRc27. After fabrication but before the creation of longitudinal slot, these components undergo a stress relieving heat treatment to relieve the internal stresses created during machining. Such treatment is desired for fabricating a metal, circular slotted part. The internal stress can cause the components to deform after slotting if not relieved. A preferred process for this heat treatment comprises heating the components to a temperature of about 1050° F. for 2 hours in an oxygenless atmosphere. The oxygenless atmosphere may be provided by an argon gas blanket although other suitable methods known in the art may be employed. Next the components are furnace cooled to a temperature of about 700° F. before air cooling to ambient temperature. Alternatively, the components may then be plated with a high phosphorous electroless nickel for corrosion resistance and baked for about 8 hours at about 350–375 degrees F.

Figure 6:
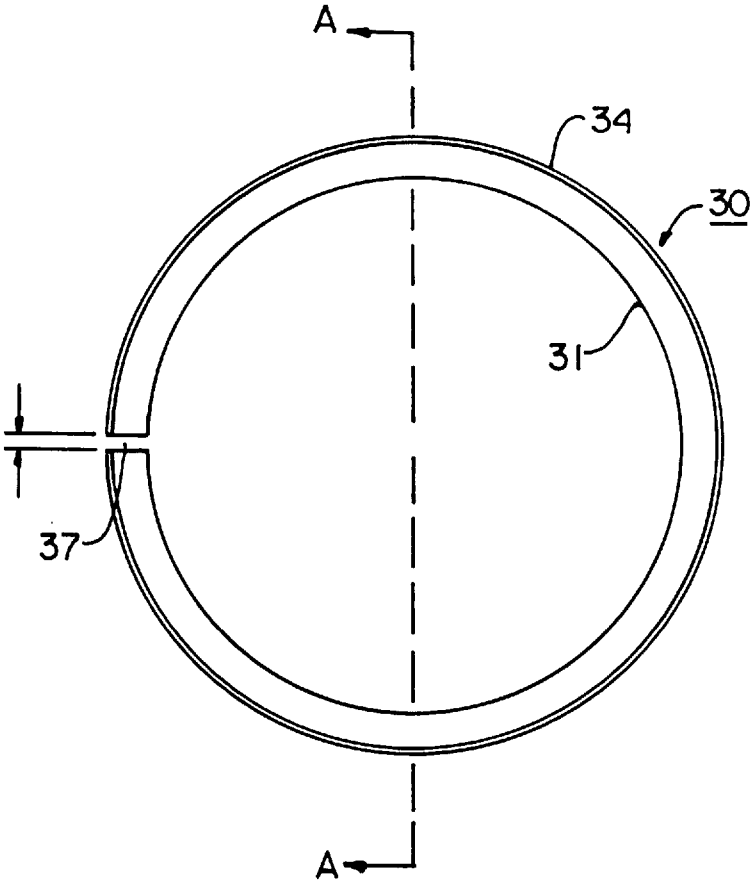
FIG. 6 is a front view of the seal of the present invention.

Although a preferred embodiment shown in FIGS. 2–5 includes the longitudinal slot, the scope of the present invention includes providing the piston 20 without a slot. This embodiment is depicted in FIG. 6.

Also in FIG. 4, the cooperation between the piston 20 and the piston seal 30 is illustrated. Upon firing propellant gas generated by the shotgun shell powder charge enters the gas chamber 7 via opening 12 and drives the singular piston/piston seal unit rearward along the magazine tube 4. The force acting on the front end 32 of piston seal 30 causes angled mating surfaces 29, 39 to contact one another. As the piston 20 and the piston seal 30 move relative to each other, the piston seal 30 flexes outwardly and is expanded against the cylinder 6 due to the resultant forces caused by the impingement of the propellant gas charge and the contact between the mating surfaces 29, 39. Simultaneously the piston 20 can be squeezed and deflected towards the magazine tube 4. Thus, the piston 20 creates a sealing contact with the magazine tube 4 as an indirect consequence of the sealing engagement between the piston seal and the gas cylinder. It should be noted that the "seal" referred to here and throughout need not be a perfect, gas tight seal in order to function properly. All that is required is that sufficient contact be made with magazine tube 4 and cylinder 6 to capture substantially all of the force generated by the powder charge propellant gas. Some small amount of gas escaping by the piston 20 and piston seal 30 will not necessarily effect the proper functioning of the gas operating device of the present invention. Nevertheless, and as illustrated in FIG. 2, it is desirable to orient the longitudinal slots 27, 37 so that they are not in alignment in order to create a desirable seal.

This concept has provided superior operating results compared to those of the seal mechanism currently in use, and similar to that disclosed in the '710 patent discussed above. A bolt velocity test was conducted using 8 Remington® Model 11-87 shotguns, firing 40 rounds/gun. A total of 160 rounds were fired with the prior art design with an average maximum bolt velocity of 307.3 in./sec. An additional 160 rounds were fired using the present invention and provided an average maximum bolt velocity of 329.3 in./sec.; an improvement of 22 in./sec.

Figure 7:
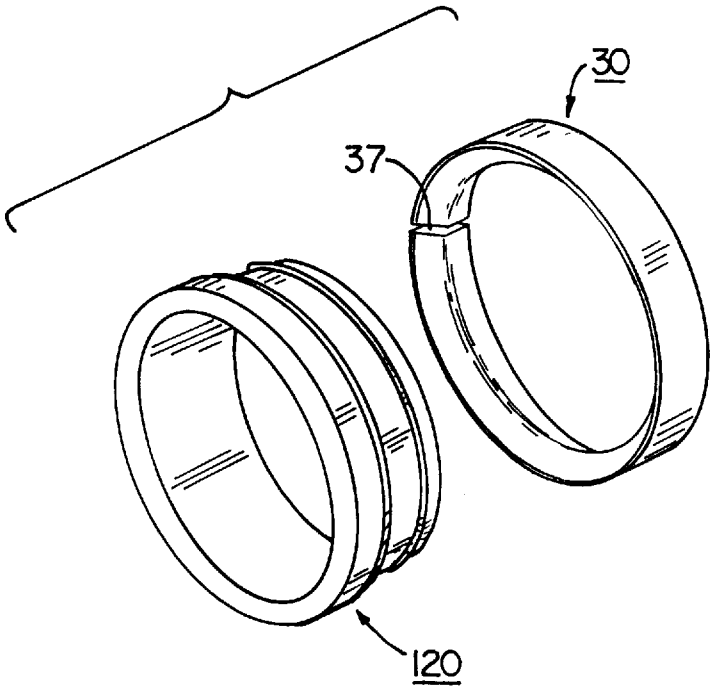
FIG. 7 is an exploded perspective view of another embodiment of the piston/piston seal of the present invention.

In another preferred embodiment, the longitudinal slot 27 in the piston 20 is omitted. As shown in FIG. 7, piston 120 has no longitudinal slot. Tests have revealed the somewhat unexpected results of successful autoloading operation with an unslotted piston 120. Bolt velocity measurements of an unslotted piston 120 have been within acceptable performance ranges. The reason for these results appear to relate to the orientation of the parts when assembled. During operation, the orientation and expansion of the piston seal 30 in relation to the port 12, in cooperation with the orientation of the piston 120, can be sufficient to cycle the action bar sleeve. In other words, since the piston seal 30 when assembled is in close proximity to the port 12, the piston seal 30 is first exposed to the powerful propellant gas pressure. If the piston seal 30 effectively expands to form a seal with the inside walls of the gas cylinder, sufficient force is created against the piston seal 30. The piston seal 30 then presses against the piston 20, which then forces the action bar sleeve back along the magazine tube. A more effective seal can be obtained when the piston seal 30 is slotted, as in this embodiment. However, providing an unslotted piston 120 does not have a detrimental effect on the operation of the autoloading feature, since the piston 120 in this configuration is not exposed to a significant amount of propellant gas pressure.

Removing the slot from piston 120 has several advantages. Additional labor is not required to machine the slot, and also the stress relieving heat treating step may be eliminated. Avoiding such steps can reduce costs and production time significantly for the piston 120.

The piston/piston seal combination of the present invention provides a number of advantages over other designs. For example, the combination travels the magazine tube as a singular unit making customer disassembly and assembly of the firearm easier and reduces the risk of reassembling the firearm incorrectly. Although the piston and piston seal comprise a singular unit during operation, they may be separated easily for cleaning.

Another advantage of the present invention resides in its improves reliability. The design of the '710 patent, as discussed above, represented a significant improvement over previous designs. However, the piston and piston seal of that design employed a nesting relationship that resulted in the piston seal having a gimbal-like sliding movement relative to the piston. This movement and inherent instability could contribute to stress cracking problems that could cause the firearm to fail. In the present invention, the gas cylinder seal rides on the piston and does not contact the magazine tube. Thus, deposits left by the powder charge propellant gases are not encountered by the piston seal. The seal is thus much less susceptible to twisting. Moreover, the strength of the seal becomes less important resulting in a component that is simpler, smaller yet still not be susceptible to breakage.

Yet another advantage of the present design is the ability to increase the piston length-to-diameter ratio to at least about twice that of the '710 patent design. The piston is more stable and again is less likely to twist or bind on the magazine tube.

Although the present invention has been described with preferred embodiments, it is to be understood that modifications and variations may be utilized without departing from the spirit and scope of this invention, as those skilled in the art will readily understand. Such modifications and variations are considered to be within the purview and scope of the appended claims and their equivalents.

What we claim is:

1. A gas sealing device for a gas-operated firearm, the gas sealing device comprising:

a) a piston having a substantially flat annular land surface positioned between a lateral flange and a peripheral raised rib;

b) a piston seal radially mounted on the land surface and positioned between the lateral flange and the peripheral rib; and c) the piston and the piston seal both having non-vertical inclined surfaces that are substantially parallel to one another.

2. A gas sealing device according to claim 1 where the piston and the piston seal function as a singular unit during the operation of the firearm.

3. A gas sealing device according to claim 1 where upon firing the piston is deflected towards a magazine tube responsive to a force applied by the piston seal due to the impingement of a propellant gas charge on the piston seal.

4. A gas sealing device according to claim 1 where the gas-operated firearm has a magazine tube and gas cylinder, where the piston is in slidable contact with the magazine tube.

5. A gas sealing device for a gas-operated firearm having a gas cylinder and magazine tube, the device comprising:

a) a piston having a substantially flat annular land surface positioned between a lateral flange and peripheral raised rib; and b) a piston seal encircling the land surface and positioned between the lateral flange and the peripheral rib, whereby the piston and the piston seal are constructed and positioned such that, during firing of the firearm, the piston is directed toward the magazine tube primarily responsive to a force applied by the piston seal due to the impingement of a propellant gas charge on the piston seal.

6. A gas sealing device according to claim 5 where the piston has an inclined surface; the piston seal has an inclined surface; where both inclined surfaces being cooperatively positioned and configured to cause the piston to form a seal with the magazine tube and the piston seal to form a seal with the gas cylinder.

7. A gas sealing assembly for a gas-operated firearm having a magazine tube comprising:

a) a piston having an inside diameter, an outside diameter, a front end and a back end, the piston comprising:
i) a lateral flange at the piston back end;
ii) an outwardly facing peripheral raised rib spaced apart from the lateral flange,
wherein the inside diameter of the piston is in sliding contact with the magazine tube; and b) a piston seal encircling the piston and positioned entirely between the lateral flange and the peripheral raised rib for sealing engagement with gas cylinder, whereby the piston and the piston seal are constructed and positioned such that they cooperatively interact to achieve adequate sealing during the operation of the firearm.

8. The assembly according to claim 7 wherein the piston further comprises a longitudinal slot.

9. The assembly according to claim 7 wherein the piston seal further comprises a longitudinal slot.

10. A gas sealing device for a gas-operated firearm having a gas chamber defined between a magazine tube and a surrounding cylinder comprising:

a) a piston having an outside diameter, a front end and back end, the piston comprising:
i) a lateral flange positioned at the back end;
ii) a peripheral raised rib positioned on the outside diameter of the piston and spaced apart from the lateral flange,
wherein the piston is in sliding contact with the magazine tube during firing; and b) a piston seal encircling the piston and positioned entirely between the lateral flange and the peripheral raised rib for sealing engagement with the cylinder.

11. A gas sealing device for a gas-operated firearm comprising:

a) a piston having a back end, a front end, and a lateral flange located at the back end; and b) a piston seal concentrically positioned on the piston forward of the lateral flange but rearward of the front end, whereby the piston is constructed and positioned such that during operation seals against a magazine tube primarily due to the force applied to the piston by the piston seal, the force resulting from a propellant gas charge.

12. A gas sealing device according to claim 11 further comprising a substantially flat annular land surface defined between the lateral flange and an outwardly facing peripheral raised rib spaced apart from the lateral flange.

13. A gas sealing device for a gas-operated autoloading firearm having a gas cylinder and a magazine tube, the device comprising:

a) an unslotted piston configured so as to be slidably mounted on the magazine tube and having a front end;

b) a slotted piston seal positioned radially on the piston rearward of the front end and in such a manner that the piston seal remains positioned on the piston during operation of the firearm, the slotted piston seal constructed and positioned to be operable to substantially form a seal between the piston seal and gas cylinder sufficient to allow the gas-operated firearm to accomplish its autoloading function; and c) the unslotted piston comprises a first inclined surface, and the slotted piston seal comprises a second inclined surface, the first inclined surface contacting during operation of the firearm with the second inclined surface to cause the piston to substantially form a seal with a magazine tube.

14. The gas sealing device of claim 13 where the contact between the first and second inclined surface also causes the piston seal to substantially form a seal with the gas cylinder.

15. A gas-operated autoloading firearm comprising:

a) a barrel assembly mounted in a receiver;

b) a magazine tube mounted at its rear end in the receiver and positioned adjacent and parallel to the barrel;

c) a gas operating device for operating the autoloading feature of the firearm comprising:
a cylinder mounted on the barrel and surrounding at least a portion of the magazine tube and in communication with the barrel via at least one opening in the barrel;
a gas chamber defined between the magazine tube and the cylinder;
a piston positioned in the gas chamber and having an outside diameter, a front end and a back end, the piston comprising a lateral flange positioned at the back end and a peripheral raised rib positioned on the outside diameter of the piston and spaced apart from the lateral flange,
wherein the piston is in sliding contact with the magazine tube during firing;
a piston seal encircling the piston and positioned between the lateral flange and the peripheral raised rib for sealing engagement with the cylinder;
the piston and the piston seal both having non-vertical inclined surfaces that are substantially parallel to one another; and d) an action bar sleeve mounted on the magazine tube and in slidable contact with the piston and operable to assist in the functioning of the autoloading feature of the firearm by being responsive to a propellant gas charge entering the gas chamber through the at least one opening.

16. A gas sealing device for a gas-operated firearm, the gas sealing device comprising:

a) a piston having an exterior surface and an interior surface, the interior surface being a substantially flat annular surface, the exterior surface comprising a substantially flat annular land surface positioned between a lateral flange and a peripheral raised rib, the lateral flange having a non-vertical incline;

b) a piston seal having an exterior surface, an interior surface and a non-vertical incline, the exterior and interior surfaces being substantially flat annular surfaces; and c) the piston seal being radially positioned on the land surface between the lateral flange and the peripheral rib, the piston incline and the piston seal incline being substantially parallel to one another.

* * * * *